US006100481A

United States Patent [19]

Castonguay et al.

[11] Patent Number: 6,100,481

[45] **Date of Patent: *Aug. 8, 2000**

[54] CIRCUIT BREAKER OPERATING HANDLE TORQUE COMPENSATION ASSEMBLY

[75] Inventors: Roger N. Castonguay, Terryville; James L. Rosen, West Hartford; Dean A. Robarge, Southington, all of Conn.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/878,596

[22] Filed: Jun. 19, 1997

[51] Int. Cl.[7] ..... H01H 3/04

[52] U.S. Cl. ..... 200/335

[58] Field of Search ..... 200/332, 335; 74/519, 523

[56] References Cited

U.S. PATENT DOCUMENTS

| | | | |
|---|---|---|---|
| 2,454,341 | 11/1948 | Repka | 200/332 |
| 3,084,238 | 4/1963 | Baskerville | 200/400 |
| 3,095,489 | 6/1963 | Baird | 200/153 |
| 3,729,065 | 4/1973 | Baskerville et al. | 185/39 |
| 3,959,615 | 5/1976 | Zaffrann, Jr. et al. | 200/335 X |
| 4,167,988 | 9/1979 | Acampora et al. | 185/40 R |
| 4,475,021 | 10/1984 | Yoshinori et al. | 200/153 SC |
| 4,672,501 | 6/1987 | Bilac et al. | 361/96 |
| 4,902,864 | 2/1990 | Markowski et al. | 335/189 |
| 5,247,850 | 9/1993 | Lenzke | 74/523 |

*Primary Examiner*—Renee Luebke

*Attorney, Agent, or Firm*—Cantor Colburn LLP; Carl B. Horton

[57] ABSTRACT

A circuit breaker operating handle charging torque compensating module includes an operating handle lever connecting between the operating handle and a support frame by means of an extension spring to maintain a uniform force exerted by the operating handle extension spring.

16 Claims, 5 Drawing Sheets

CIRCUIT BREAKER OPERATING HANDLE TORQUE COMPENSATION ASSEMBLY

BACKGROUND OF THE INVENTION

Air circuit breakers as described within U.S. Pat. No. 3,095,489 entitled "Manual Charging Means for Stored Energy Closing Mechanisms of Electric Circuit Breakers" and U.S. Pat. No. 3,084,238 entitled "Ratchet Mechanism for Charging a Closing Spring in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

Such air circuit breakers are usually provided with a motor operator such as described in U.S. Pat. No. 4,167,988 entitled "Ratcheting Mechanism for Circuit Breaker Motor Operator" or a manual handle as described in U.S. Pat. No. 3,729,065 entitled "Means for Charging A Stored Energy Circuit Breaker Closing Device" for charging the powerful closing springs contained within the air circuit breaker operating mechanism.

When the circuit breaker closing springs are brought to their fully-charged conditions, it is important that the springs do not become inadvertently discharged while an operator has hold of the charging handle in order to avoid damage to the ratchet mechanism and the associated air circuit breaker contacts. An early arrangement of a latching means to prevent rotation of a closing springs charging handle is found in U.S. Pat. No. 4,475,021 entitled "Air Circuit Breaker".

As the circuit breaker operating handle is pumped to provide the necessary charging force to the circuit breaker closing springs, the torque reflected back to the operating handle increases in proportion to the closing spring forces. Also added to this operating force is the torque generated by the handle return spring per se.

It would be beneficial to an operator to be able to provide charging forces to the circuit breaker closing springs without having to overcome the large forces that are being generated by the handle return spring.

One purpose of the invention, accordingly, is to provide a modular assembly that can be attached to the circuit breaker in the vicinity of the operating handle, both during factory assembly as well as on-site, to maintain a constant low circuit breaker closing spring charging force to the circuit breaker operating handle by reducing the torque requirement of the handle return spring in a manner that does not impede the ability of the return spring from sufficiently returning and holding the operating handle in its home position.

SUMMARY OF THE INVENTION

A circuit breaker operating handle assembly of modular design for ease of adaptation to a circuit breaker operating mechanism. The handle assembly incorporates an extension spring for returning and retaining the handle in a home position. The extension spring interacts with the operating handle whereby unnecessary additional torque is not generated when the handle is rotated to charge the circuit breaker closing springs.

DESCRIPTION OF THE PREFERRED EMBODIMENT

Figure 1:
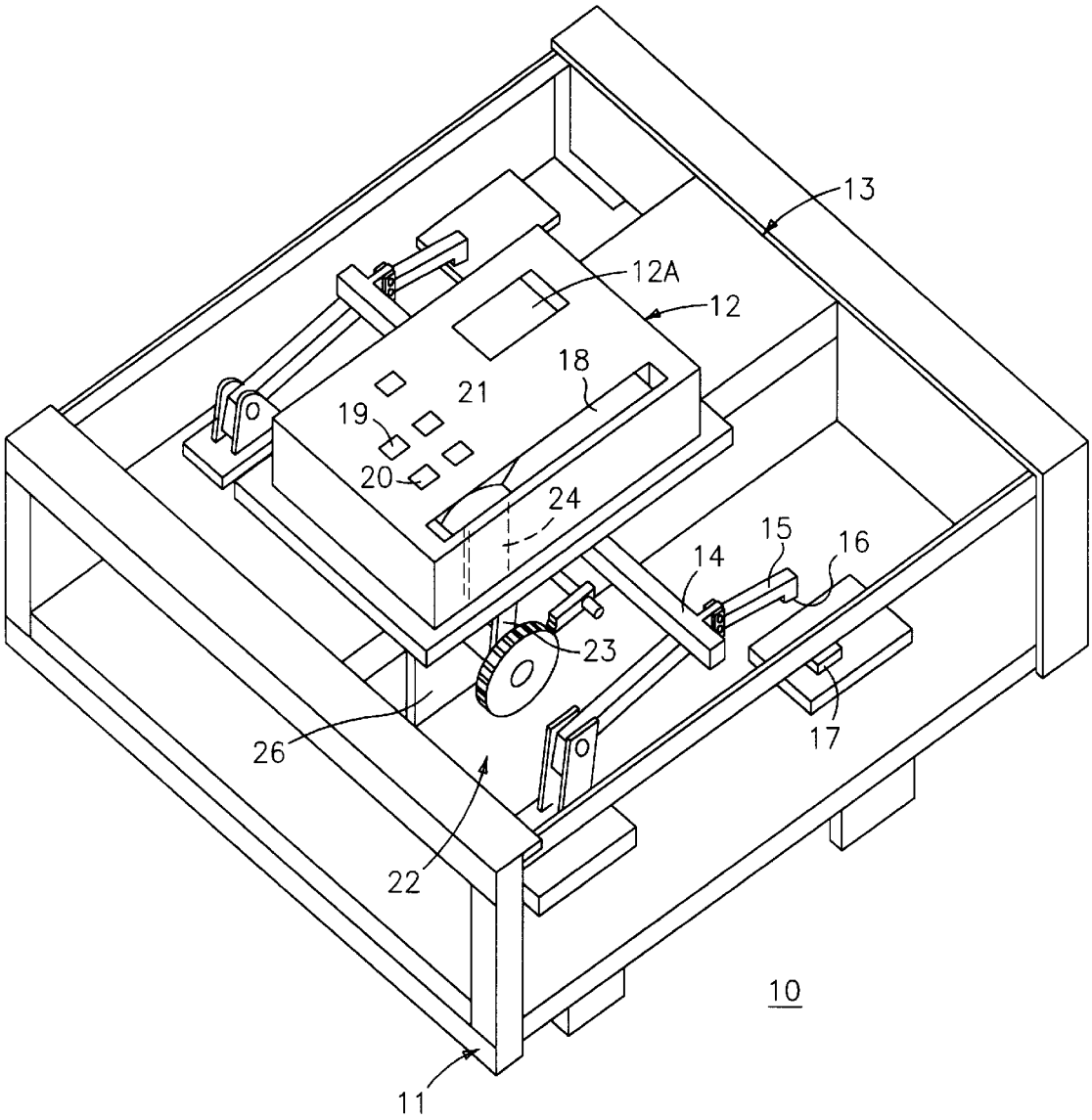
FIG. 1 is top perspective view of an air circuit breaker containing the circuit breaker operating handle charging torque compensating module according to the invention.
Figure 2:
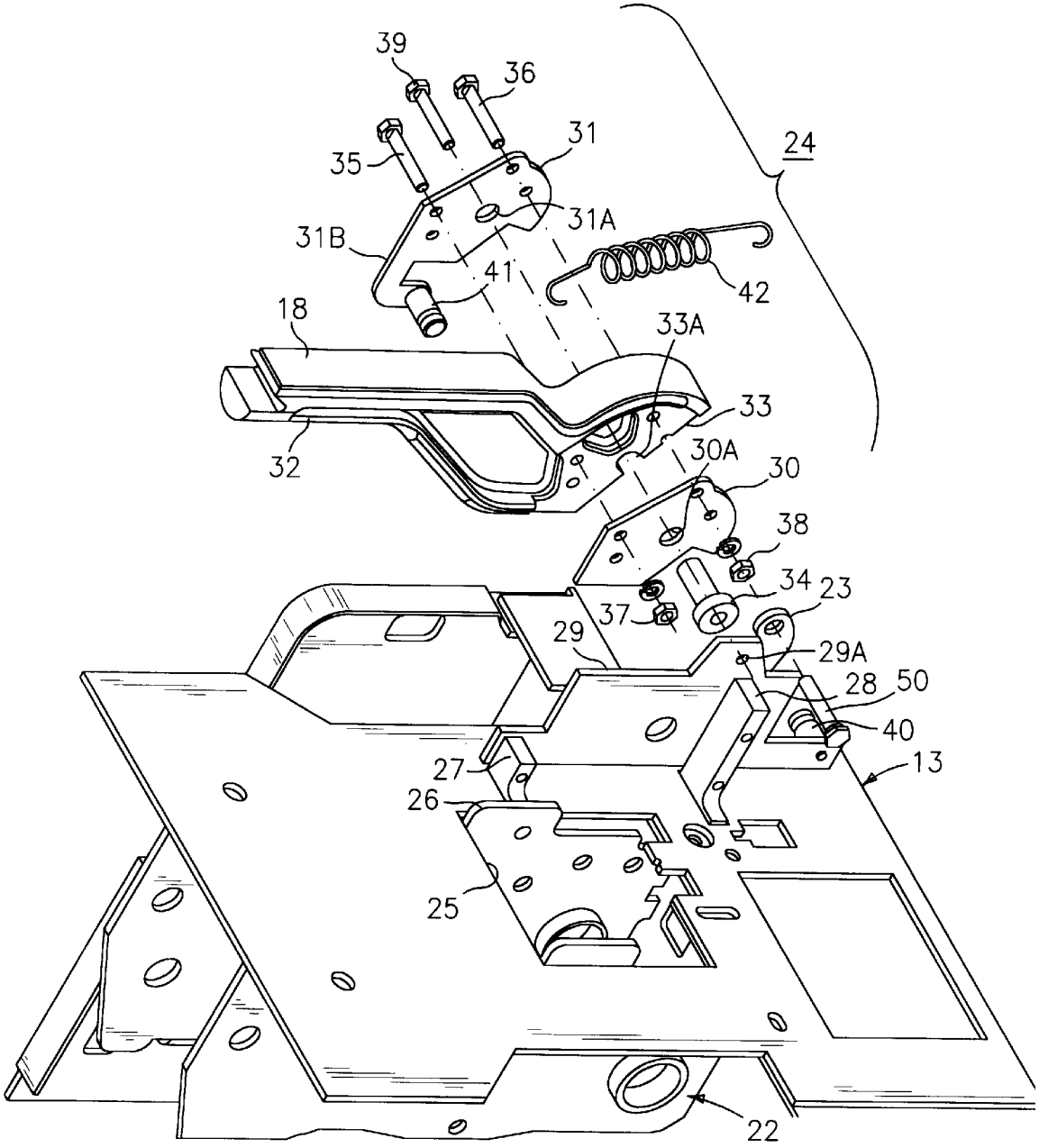
FIG. 2 is an enlarged top perspective view of the compensating module of FIG. 1 with the components arranged in isometric projection to the circuit breaker operating handle and the circuit breaker operating components enclosure.

The air circuit breaker 10 of FIGS. 1 and 2 is similar to that described within the aforementioned U.S. Pat. No. 3,095,489 and includes a metal frame 11 which supports circuit breaker cover 12, the trip unit programmer 12 A and the operating mechanism enclosure 13. The trip unit programmer is similar to that described in U.S. Pat. No. 4,672,501 entitled "Circuit Breaker and Protective Relay Unit". The cover further includes a trip or OFF button 19 for releasing the circuit breaker operating mechanism contained within the enclosure 13 for separating the circuit breaker contacts 16, 17 to their open condition and a closing button 20 for moving the contacts to their closed position. The circuit breaker contact arms 15 within each pole of a three pole circuit arrangement, are interconnected by means of the operating mechanism crossbar 14 to insure that all contacts within the separate poles both open and close in unison, improving over the earlier mechanism described in the aforementioned U.S. Pat. No. 3,729,065 by allowing the operating mechanism closing springs described therein to be charged remotely by means of a motor. The operating handle 18 consisting of the handle plate 33 and handle grip 32, interacts with the ratchet mechanism 22 by means of a handle lever indicated at 23. In accordance with the invention, a circuit breaker operating handle torque compensation module 24, which includes the circuit breaker operating handle, is best seen by now referring to FIG. 2.

A pair of side levers 30, 31 are attached to the operating handle 18 by means of bolts 35, 36 and nuts 37, 38 and the handle pivot pin 34 is inserted within the apertures 30A, 31A and 33Abefore securing to support frame 29 by means of the extended screw 39 threaded into tapped hole 29A. The torque compensation module 24 now connects with the support frame 29 and is attached to the operating mechanism sideframe 26 by means of the brackets 27, 28 and is positioned next to the rectangular opening 25 through which the sideframe 26 of the operating mechanism 22 (FIG. 1) extends. The side lever 31 defines a tab extension 31B to which a spring support post 41 is attached. A similar spring support post 40 is attached to the support frame 29 and a handle extension spring 42 is positioned between the posts in the manner shown in FIG. 3.

Figure 3:
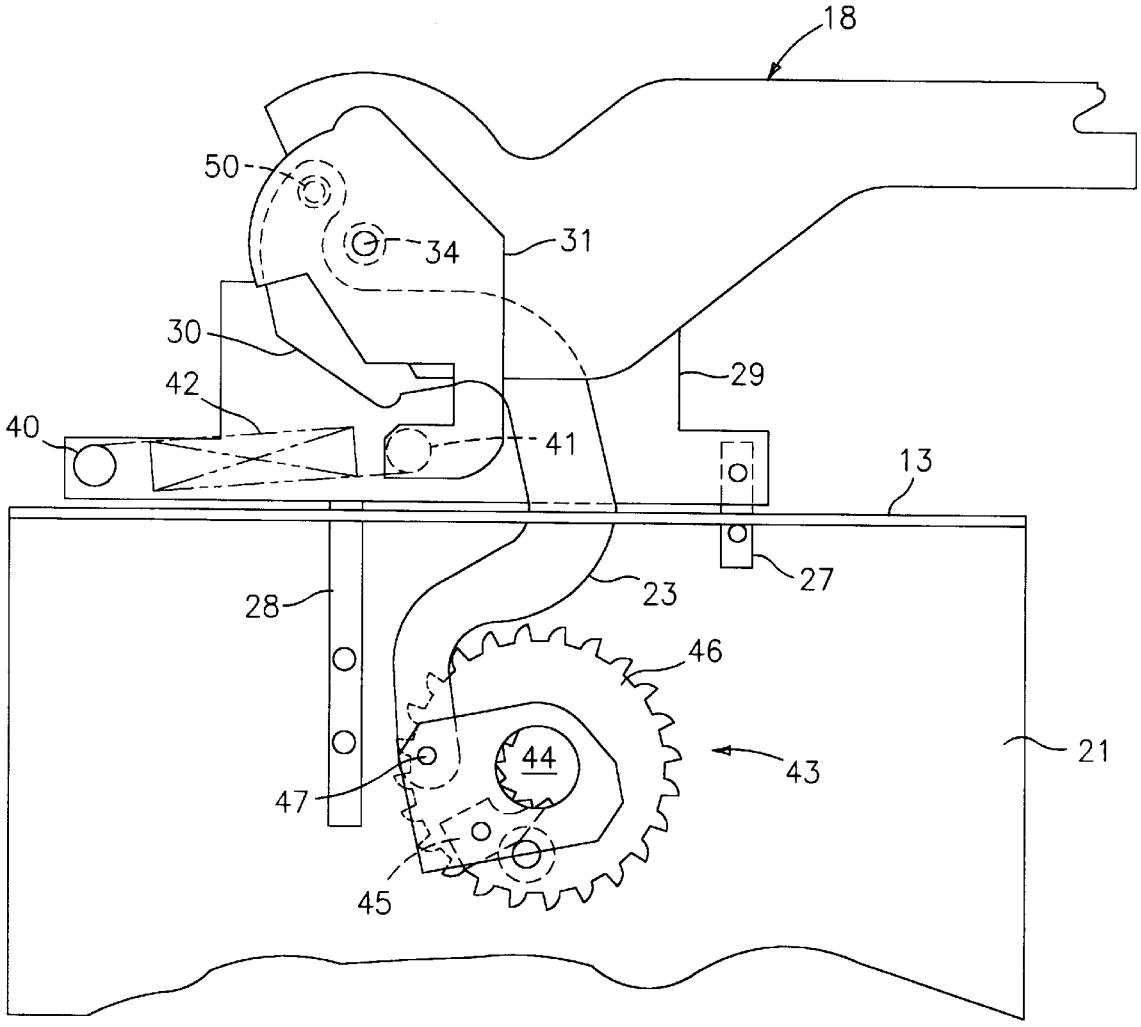
FIG. 3 is an enlarged side view of the circuit breaker of FIG. 1 depicting the circuit breaker operating handle in a home position and the circuit breaker closing spring charging gear in an uncharged condition.

Referring now to FIG. 3, the operating handle 18 is depicted in its rest position above the operating mechanism enclosure 13 with the handle lever 23 attached to the operating handle by means of the bolt 50 (FIG. 2) at one end and attached to the holding gear 46, within the closing spring charging mechanism 43, by means of the bolt 47 at the opposite end thereof. The support frame 29, attached within the operating mechanism sideframe 26 by means of the brackets 27, 28 locates the handle pivot pin 34between the side levers 30, 31 and positions the handle extension spring 42 between the spring support posts 40, 41 such that when the circuit breaker operating spring (not shown) is in its uncharged condition, the charging pawl 45 is away from the charging gear 44 and the handle extension spring 42 is in an un-extended condition.

Figure 4:
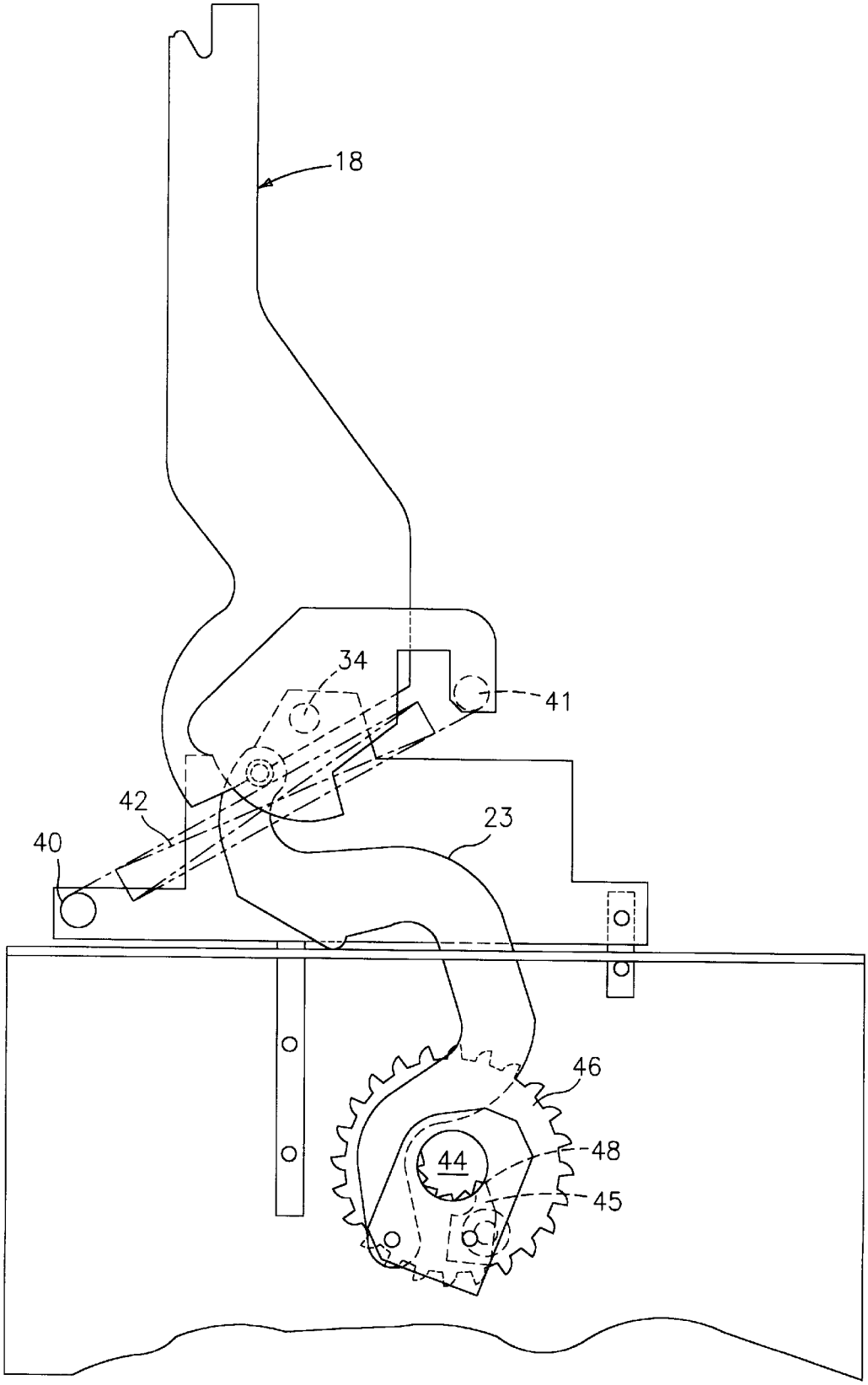
FIG. 4 is an enlarged side view of the circuit breaker of FIG. 1 with the circuit breaker operating handle in an extended position and the circuit breaker closing spring charging gear in a charged condition.
Figure 5:
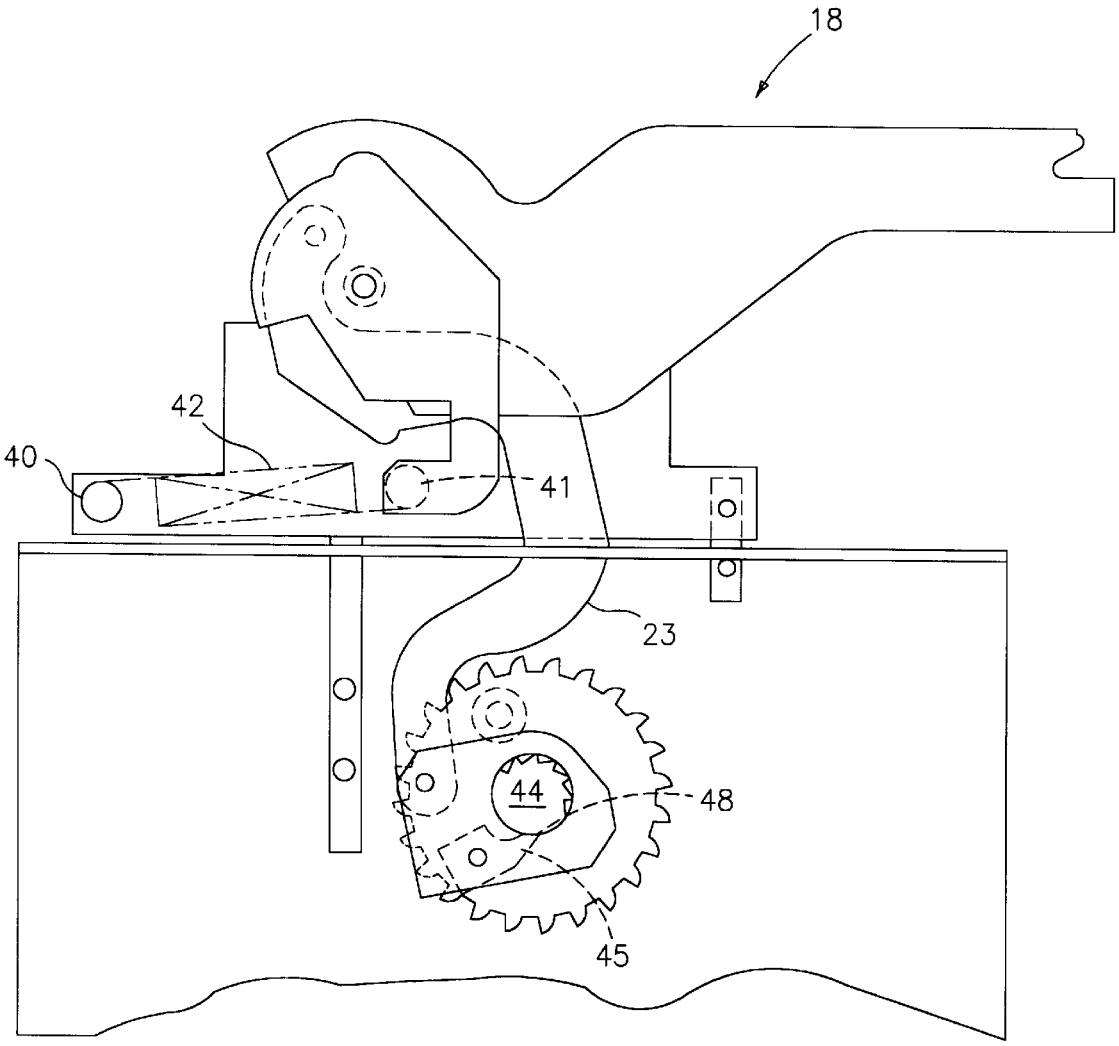
FIG. 5 is an enlarged side view of the circuit breaker of FIG. 1 depicting the circuit breaker operating handle in a home position and the circuit breaker closing spring charging gear in a charged condition.

In FIGS. 4 and 5, the operating handle 18 is rotated counter-clockwise about the pivot pin 34 to the position shown in FIG. 4 to charge the closing spring (not shown) such that the charging pawl 45 engages the charging gear 44 as the handle lever 23 rotates the holding gear 46 in the counter-clockwise direction. The handle extension spring 42 extends to its stretched position between the posts 40, 41 to assist the return of the handle 18 to the home position shown in FIG. 5. The handle extension spring 42 returns to its relaxed condition between the posts 40, 41 and the charging pawl moves to the smooth side of the charging gear 44, as indicated at 48.

What is claimed is:

1. A circuit breaker operating handle torque compensation assembly, for use with a circuit breaker spring charging system contained in an operating mechanism enclosure and having a circuit breaker operating handle with a plurality of apertures, said handle rotatably operable in a first plane, said torque compensation assembly comprising:

a first and second side lever, each having a first portion adaptable for mounting on opposing sides of said circuit breaker operating handle, said side levers having a plurality of apertures matching said handle apertures;

said first side lever further including a tab extending from said first portion, said tab having a first spring post mounted to said tab and said first spring post rotatable with said handle in said first plane;

a spring connected between said first post and adapted to connect to a second post mounted on said circuit breaker spring charging system, said posts being external to said operating mechanism enclosure;

a plurality of fasteners extending from said side levers for attaching said side levers to said handle;

wherein said torque compensation assembly is adapted to provide said circuit breaker operating handle with a biasing force to assist said operating handle to return to a home position from an extended position.

2. A torque compensation assembly as in claim 1 wherein each of said side levers first portion is essentially of planar construction.

3. A torque compensation assembly as in claim 1 wherein said tab is essentially of planar construction.

4. A torque compensation assembly as in claim 1 wherein said first side lever first portion is essentially co-planar with said tab.

5. A torque compensation assembly as in claim 1 wherein a longitudinal axis of said first post lies between an axis of rotation of said handle and said operating enclosure when said handle is in said home position.

6. A torque compensation assembly as in claim 1 wherein said side levers are mountable so as to be essentially parallel with each other.

7. The compensation assembly of claim 1 including a handle pivot extending between said first side lever and said second side lever for allowing rotation of said operating handle between a home position and an extended position.

8. The compensation assembly of claim 7 wherein said spring becomes extended when said operating handle is rotated from said home position to said extended position.

9. A circuit breaker comprising:

a fixed and a movable contact arranged for connection within an electric circuit;

a movable contact arm connecting with a circuit breaker operating mechanism at one end and with said movable contact at an opposite end for opening and closing said movable contact from and to said fixed contact upon actuation of said circuit breaker operating mechanism;

a circuit breaker operating handle connecting with a ratcheting assembly for providing charging force to a circuit breaker closing spring;

a handle lever connecting said operating handle with a closing spring charging mechanism for allowing rotation of said charging mechanism upon rotation of said operating handle in a first direction;

a first and second side lever, each having a first portion mounted on opposing sides of said circuit breaker operating handle, said side levers and said handle having a plurality of matching apertures, said handle rotatably operable in a first plane;

said first side lever further including a tab extending from said first portion, said tab having a first spring post mounted to said tab and said first spring post rotatable with said handle in said first plane;

a spring connected between said first post and a second post mounted on said circuit breaker spring charging system; said posts being external to an operating mechanism enclosure;

whereby said operating handle is provided with a biasing force to assist said operating handle to return to a home position from an extended position.

10. A circuit breaker as in claim 9 wherein each of said side levers first portion is essentially of planar construction.

11. A circuit breaker as in claim 9 wherein wherein said tab is essentially of planar construction.

12. A circuit breaker as in claim 9 wherein said first side lever first portion is essentially of co-planar with said tab.

13. A circuit breaker as in claim 9 wherein a longitudinal axis of said first post lies between an axis of rotation of said handle and said operating enclosure when said handle is in said home position.

14. A circuit breaker as in claim 9 wherein said side levers are mounted so as to be essentially parallel with each other.

15. The circuit breaker of claim 9 including a handle pivot extending between said first side lever and said second side lever for allowing rotation of said operating handle between said home position and said extended position.

16. The circuit breaker of claim 15 wherein said spring becomes extended when said operating handle is rotated from said home position to said extended position.

* * * * *